United States Patent [19]

Milligan et al.

[11] 3,938,686

[45] Feb. 17, 1976

[54] PAINT CONTAINER

[76] Inventors: Robert T. Milligan, 532 Leverington Ave., Philadelphia, Pa. 19128; Robert H. Vernon, Hagues Mill Road, Ambler, Pa. 19002

[22] Filed: Nov. 18, 1974

[21] Appl. No.: 525,043

[52] U.S. Cl. ..... 215/232; 15/257.05; 206/457; 206/459; 215/247; 215/250; 220/90; 229/3.5 R; 229/43

[51] Int. Cl.[2] ..... B65D 23/06

[58] Field of Search ..... 215/232, 247, 250, 253; 220/4 A, 90, 306; 206/361, 119, 118, 81, 457, 819, 459; 229/3.5 R, 43; 35/28.3, 28.5; 15/257.05

[56] References Cited

UNITED STATES PATENTS

| | | | |
|---|---|---|---|
| 402,859 | 5/1889 | Rose | 206/81 |
| 1,916,977 | 7/1933 | Gutmann | 215/232 |
| 2,413,449 | 12/1946 | Hatch | 215/232 |
| 2,436,291 | 2/1948 | Daniel | 220/90 |
| 2,890,530 | 6/1959 | Goldsholl et al. | 206/81 |
| 3,054,703 | 9/1962 | Brasure | 206/819 |
| 3,272,422 | 9/1966 | Miller | 229/43 |
| 3,298,505 | 1/1967 | Stephenson | 229/43 |
| 3,632,004 | 1/1972 | Grimes et al. | 215/232 |
| 3,767,076 | 10/1973 | Kennedy | 215/232 |

FOREIGN PATENTS OR APPLICATIONS

| | | | |
|---|---|---|---|
| 500,032 | 6/1951 | Canada | 215/232 |

*Primary Examiner*—William Price
*Assistant Examiner*—Bruce H. Bernstein
*Attorney, Agent, or Firm*—Steele & Petock

[57] ABSTRACT

A paint container comprising a clear plastic sidewall construction preferably of polypropolene enabling the accurate observation of the paint contained therein through the walls of the container. The closure member comprises a multi-laminate seal including prestressed films designed to enable a slit to be made in the seal surface permitting access to the paint while providing advantages set forth in detail herein.

7 Claims, 3 Drawing Figures

PAINT CONTAINER

BACKGROUND OF THE INVENTION

1. Field of the Invention

The subject invention has utility in the packaging industry and is specifically designed to accommodate small quantities of paint which may be quickly purchased by a consumer and efficiently utilized eliminating many of the heretofore objectionable problems and difficulties associated with painting.

2. Prior Art

As is well known to virtually all consumers, paint is and has been in recent years packaged almost solely in metal containers of which the most common are metal cans utilizing a closure member which must be pried open by a screwdriver or other pointed means. Many problems are manifest in the utilization of such containers. The paint contained in the containers cannot be seen through the sidewalls; thus, it is not possible to accurately visualize the contents unless the container is opened. Furthermore, there is considerable difficulty with opening the closure member particularly for individuals who do not possess a reasonable amount of manual dexterity. In addition, problems are associated with reclosing the closure member after use since by this time paint has most likely filled the channel groove portions which receive the standard paint closure member. Spillage usually results and the operation usually results, with all but the most careful users, getting paint on themselves and surrounding objects.

Furthermore, with the utilization of the common metal paint cans, there is not an effective way to withdraw the paint brush from the container and control the amount of paint on the brush during this withdrawal motion. In addition, air may reach the paint when the container top is removed with the result being the formation of a paint skin if the container is left open for any period of time. In addition, when the container is opened, the paint is not protected from dirt and other debris.

Extremely small glass jar-like containers have been used for extremely small quantities of paints for artists and the like, but such usage is not feasible for larger quantities of paint.

With respect to closure members for containers, U.S. Pat. No. 2,436,291-Daniel discloses the use of diaphragms which may be slit to obtain access to the unspecified contents of the container. In utilizing the teachings of the Daniel patent, the diaphragm members are constructed of flexible material, but if constructed according to the teachings of Daniel, flexing properties will be absent. Thus, when an applicator element is introduced and withdrawn from the container an effective closure of the access slit will not be realized. Furthermore, the diaphragm members will be pushed inwardly or in an outward direction dependent upon the movement of the applicator member. This further contributes to the inability to obtain an effective closure once the applicator member is withdrawn and air, dirt and other debris will find their way to the contents of the container.

SUMMARY OF THE INVENTION

Accordingly, it is an object of the subject invention to provide a paint container constructed of a clear material such as polypropolene to permit visual observation of the paint in its packaged state.

It is a further object of the subject invention to provide a material for a paint container which may be subjected to slight pigmentation changes to compensate for the wet-to-dry color shift of the paint to enable the actual color of the paint film when dry to be appreciated. It is still another object of the subject invention to combine the use of a new type of paint container with a closure means that will enable painting from the container to be quick and clean and which will eliminate paint contamination and lessen the danger of spills during painting.

It is still a further object of the subject invention to provide paint packaging means with which the user may introduce and withdraw his paint brush with a correct amount of paint on the brush eliminating the necessity of further wiping and tapping to remove excess paint from the brush.

It is yet another object of the subject invention to provide a paint packaging means whereby continuously moisture-saturated air is maintained above the paint so that fast-drying paint may be used at a liesurely pace over a length of time without the formation of paint-contaminating skin.

It is yet one more object of the subject invention to provide a printed surface to provide instructions to help the painter while also serving to prevent a paint-contaminating skin and to enable the effective squeegeeing of the excess paint from the brush as it is removed from the container.

In accordance with the above objects, the subject invention comprises the use of a high-impact polypropolene container of clear optical properties, thus enabling the visual observance of the paint either before or after purchase, such as at a time after the paint has been stored for a period of time and the exact color of the paint cannot be remembered. In addition, by the use of polypropolene, modified pigmentation of the cup wall can be utilized to enable the user to see the exact color of the paint when it will be dry. In addition to a reclosure cap, a multi-laminate seal means is utilized which preferably comprises three films continuously joined. A polypropolene film is joined to a mylar film which is in turn continuously joined to a fiber paper. The polypropolene mylar laminate is placed in tension during application to the cup and heat-sealed in place. The fiber paper may be laminated in a relaxed state to the stressed plastic film.

The fiber paper may be printed with instructions and have a slit outline which, when the instructions are followed, will be slit in such a manner as to accommodate a brush of specified shape and dimensions to enable effective painting from the container. As the brush is removed, excess paint will be squeegeed therefrom to enable the brush to be used in an efficient manner. As the brush is removed, the multi-laminate seal will, as a result of its construction, close to effectively seal the closure member and contain moisture-saturated air over the paint to prevent the formation of a paint-contaminating skin.

DETAILED DESCRIPTION

Figure 1:
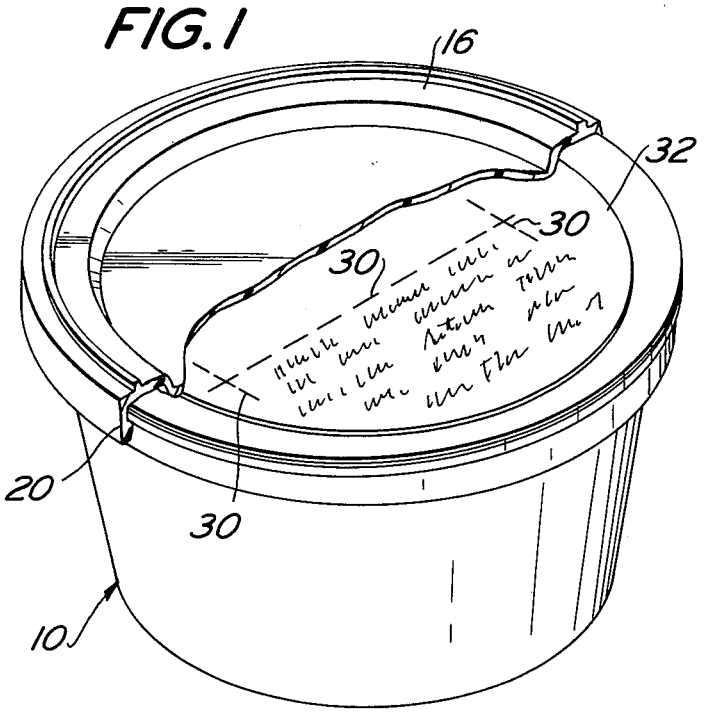
FIG. 1 is a perspective view of the subject plastic paint container including a cutaway showing of the pressure closure which exposes the printed surface of a multi-laminate seal.
Figure 1:
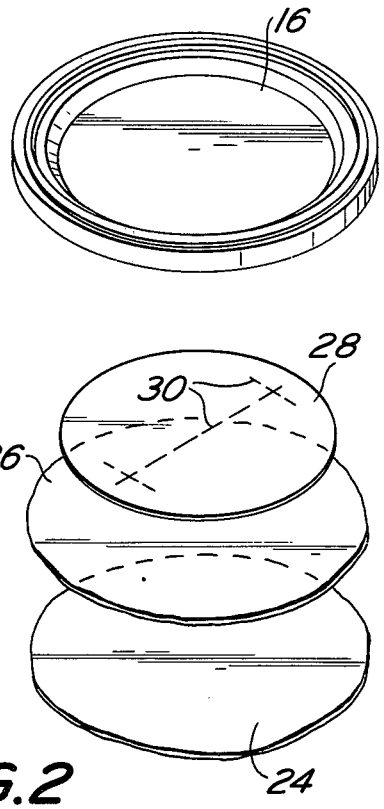
Figure 2:
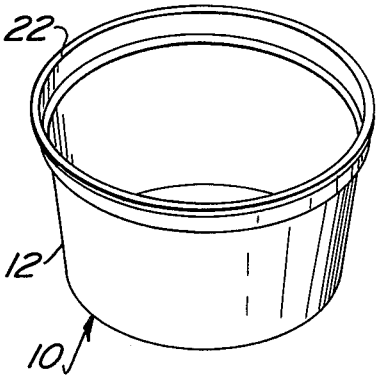
FIG. 2 is an exploded view of the elements of the paint container from which the three films of the multi-laminate seal are readily seen.

With reference to FIG. 1, a plastic paint container 10 is disclosed which is preferably constructed of polypropolene. As seen best in FIG. 3, the container 10 includes sidewalls 12 and an integral base 14 which should not be considered to be limited to the shape and structure as disclosed herein.

A plastic pressure closure member 16 is designed to be snapped in place by means of the interlocking perifeeral structure of the closure member 16 and the container 10. As best seen in the cross-sectional view of FIG. 3, the outer vertical extension 18 of the closure member 16 has a depending inwardly directed locking ridge 20 mated to receive the top locking nub 22 of the container 10.

Across the top of the paint container 10 a multi-laminate seal is utilized which comprises three films continuously joined. The lowermost film 24 is preferably polypropolene and may be on the order of 0.005 inches thick. Continuously joined thereto is the intermediate film 26 which is preferably mylar which may be 0.001 inches thick. Continuously joined to the mylar film 26 is the uppermost film 28 which is preferably constructed of fiber paper and may be on the order of 0.002 inches in thickness.

The preferred method of joining the films is to place the polypropolene mylar laminate 24, 26 in tension during application to the container 10 and have it heat-sealed in place by any of the standard heat-sealing techniques. The fiber paper uppermost film 28 is then laminated in a relaxed state to the stressed plastic film 24, 26 which comprises the mylar and polypropolene members.

It will be observed that dashed slit lines 30 are printed on the fiber paper number 30 along with directions indicated by the markings 32 which effectively direct the user to, by means of a sharp instrument, slit the multi-laminate seal along slit lines 30 to gain access to the paint for usage thereof.

Figure 3:
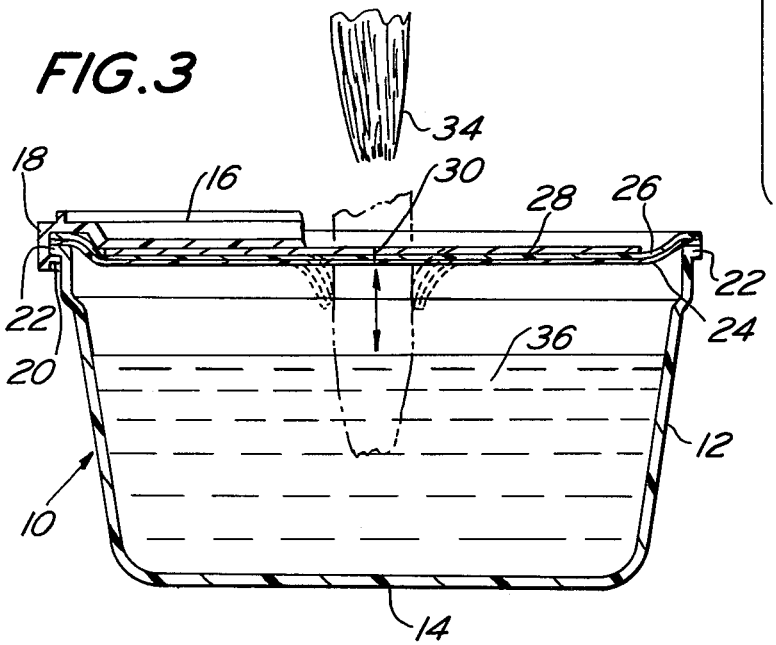
FIG. 3 is a cross-sectional elevational view of the subject paint container showing the tip of a brush about to be penetrated and further showing in phantom the penetration of the brush tip into the container closure and its emersion into the paint contained therein.

With respect to FIG. 3, a tip of a brush 34 is shown about to be inserted into the container through the lengthwise slit 30 which it will be assumed has been cut. The brush tip 34 is shown in phantom being inserted into the paint 36 as the multi-laminate seal 24, 26, and 28 yields to the downward force of the brush tip 34.

When the brush tip 34 is removed, the stressed plastic film will cause the multi-laminate seal to return to its unpenetrated position, thus effectively maintaining the moisture-saturated condition of the air immediately above the paint 36 within the container 10.

The use of a polypropolene container which is preferably clear enables the color of the paint to be determined by visual examination without the necessity of opening the container. It is well known that paint changes color slightly when it dries, and it is within the scope of the invention to provide slight pigmentation changes to the polypropolene to compensate for the wet-to-dry color shift of the paint film. In this way, the actual color of the paint film when dry can be seen from observing the combination of the wet color of the paint slightly modified by the carefully formulated pigmentation of the cup wall.

The proper balance of individual film tensions achieved during lamination of films 24, 26, and 28 produces flexing properties to cause the laminated seal to curl downward against the bristles of brush 34, squeegeeing excess paint away; not curling upward as the brush tip 34 is removed but coming to rest in a single plane to achieve closure over the paint film after the brush tip 34 is removed. Not only is the moisture-saturated condition of the air within the container maintained, but furthermore the paint is kept fresh and free of dirt and debris during the painting process, and in addition should the container be knocked over, the contents of the container will be restrained to minimize spillage. In view of the ability to maintain the continuously moisture-saturated air over the paint, fast-drying paint may be used at leisurely pace which heretofore has been extremely difficult with conventional containers.

It will be appreciated that the triple laminated seal construction 24, 26, and 28 helps to strengthen and hold round the rim of the flexible plastic container 10 during painting and moving the container from place to place during the painting process. The continuous seal, even though cut as indicated, will nevertheless reinforce the cup walls to the point where they will be prevented from bending inward from picked up. If such inward bending were not accomplished, paint would slop out of the container.

It is preferred that a high-impact polypropolene be used for the container 10 to reduce the danger of shattering. Thus, through the use of the subject invention plastic cups preferably of a polypropolene material may be combined with a specific type of laminated seal to enable painting from the container to be quick and clean and further eliminate paint contamination and lessen the danger of spills during painting. The pressure closure member 16 protects the laminate seal until the painting operation and is designed to accommodate stacking of the containers prior to sale or subsequently during storage. Once the paint has been partially used, the closure cap 16 may be snapped in place to reclose the container and the paint may be effectively stored for future use.

The subject paint container disclosed herein is especially suited for latex enamels, since it has been found that the polypropolene material is compatible with latex enamel paints.

While various embodiments of the invention have been shown and described, it will be understood that various modifications may be made. The appended claims, therefore, are intended to define the true scope of the invention.

We claim:

1. A container means for paints comprising:

an optically clear plastic cup-like container;

a multi-laminate seal secured to the top of said cup-like container, said seal comprising a first film, a second film continuously joined to said first film, and a third film continuously joined to said second film, said third film forming the outer layer of said seal, said first film and said second film being placed in tension during application to said cup-like container, said third film being applied in a relaxed state to said second film whereby when said multi-laminate seal is slit, said seal will flex inwardly when a brush is inserted therethrough and will return to its original plane when said brush is withdrawn thereby enabling the maintenance of a moisture saturated condition of air above paint contained within said plastic cup-like container; and a top closure member readily attachable and detachable to said cup-like container to provide a further means for protecting container contents.

2. The container means of claim 1 when said multi-laminate seal comprises:

a first film of polypropolene;

a second film of mylar; and a third film of fiber paper.

3. The container means of claim 1 wherein the multi-laminate seal is heat-sealed to said cup-like container.

4. The container means of claim 1 wherein said cup-like container comprises polypropolene material and further includes pigmentation of said cup-like container to compensate for wet-to-dry color shift of paint contained therein during the drying process.

5. The container means of claim 1 wherein said multi-laminate seal is of sufficient thickness and rigidity to provide stability to the cup-like container walls.

6. The container means of claim 1 wherein said third film contains instructional markings to instruct a user to slit said seal.

7. The container means of claim 6 wherein said instructional markings include a first slit line and two second slit lines disposed perpendicular to said first slit line.

* * * * *